US005570722A

United States Patent [19]

Goldsmith

[11] Patent Number: 5,570,722

[45] Date of Patent: Nov. 5, 1996

[54] VALVE RELEASE MECHANISM

[75] Inventor: Peter J. Goldsmith, Houston, Tex.

[73] Assignee: Control Rain Systems, Inc., Houston, Tex.

[21] Appl. No.: 516,492

[22] Filed: Aug. 17, 1995

[51] Int. Cl.[6] ..... B05B 1/14

[52] U.S. Cl. ..... 137/882; 239/124; 251/339

[58] Field of Search ..... 137/882; 239/124, 239/526; 251/289, 339, 322

[56] References Cited

U.S. PATENT DOCUMENTS 5,117,872 6/1992 Yie ..... 137/882

5,312,040 5/1994 Woodward ..... 239/124 X

*Primary Examiner*—John C. Fox

*Attorney, Agent, or Firm*—Robert W. B. Dickerson

[57] ABSTRACT

Mechanism for unseating a valve in a water blasting gun, the mechanism having a rod that is axially movable within a dump tube, one end of the rod being engageable with the valve, and the other rod end being linked by a pin to an operator controlled actuator.

15 Claims, 2 Drawing Sheets

VALVE RELEASE MECHANISM

BACKGROUND OF THE INVENTION

Dump type water blasting guns, of the type described by U.S. Pat. No. 5,349,982, are operated by closing the trigger, which in turn causes a valve to close. This results in the sealing off of the relatively large dump passage and forces water to flow through a much smaller nozzle orifice at a much greater pressure than the pressure at which it was previously dumping. The dump valve is biased away from its seating position by a spring. If the trigger is released, the valve will open and the former high pressure flow will, instead, dump to waste, and the pressure in the system will drop to a much lower level. If the spring acting on the valve were to break, or if dirt or some other contaminant were to accumulate in the narrow annulus between the valve stem and the guide bore in which it slides, the valve could jam. This would result in a potentially dangerous operating condition for the operator, since he would have no immediate means for releasing the high pressure, other than by shutting down the water source. Since the source may be remote from the operator, no safe viable alternative may be available. The subject matter of this invention addresses this particular problem.

SUMMARY OF THE INVENTION

A block includes a first (high pressure) fluid passageway, a second (low pressure or dump) passageway, and a third (communicating) such passageway, along with a valve control mechanism for regulating fluid flow between said high and low pressure passageways. This control mechanism includes a shiftable valve, a valve seat and further mechanism for unseating the valve in the event that the valve becomes jammed in the closed position. Such further mechanism includes a valve engaging rod and an actuator. This actuator includes a rod-engaged pin, said pin extending through transverse slots in the dump tube to be secured by an operator controlled handle which is slidably engaged with the dump tube.

DESCRIPTION OF A PREFERRED EMBODIMENT

Figure 1:
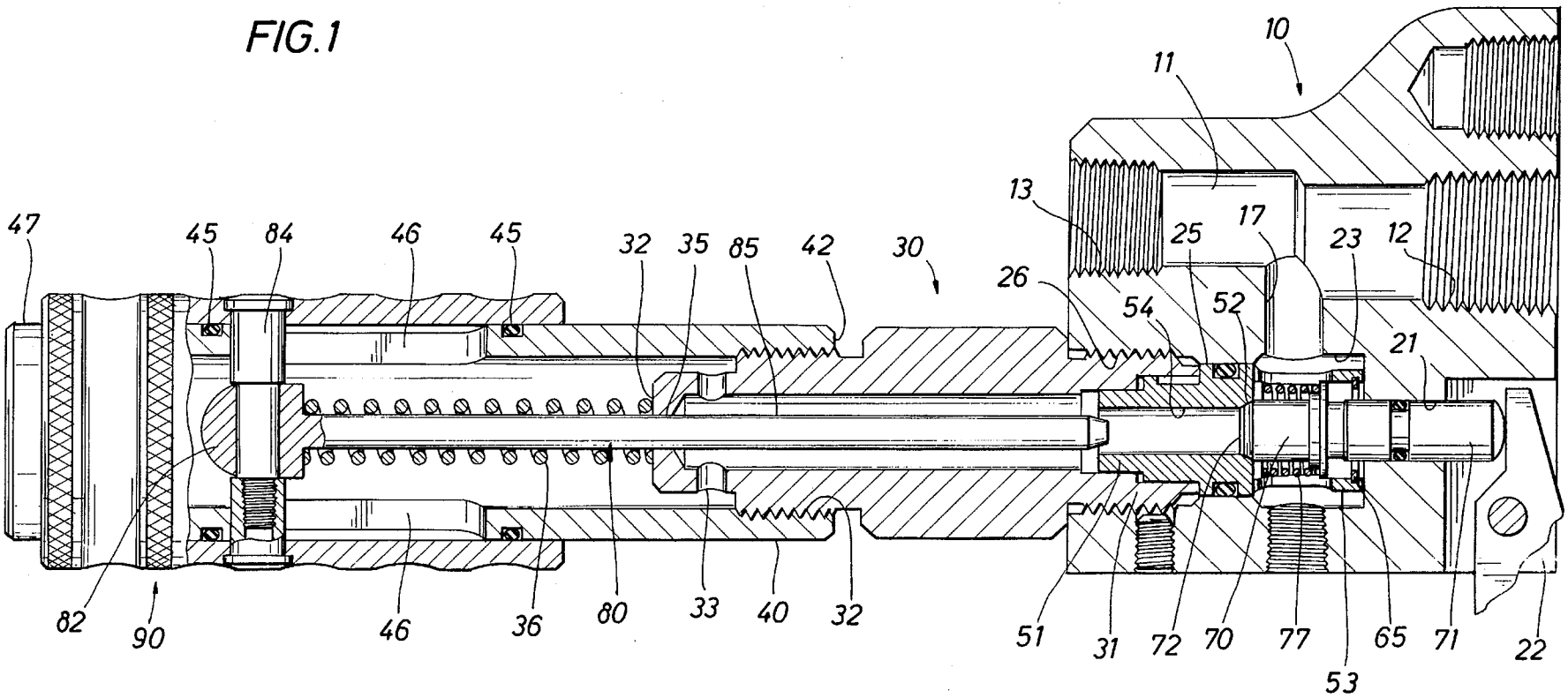
FIG. 1 is a vertical section, with the handle partially broken away, of the assembled water blasting gun, minus the barrel.
Figure 2:
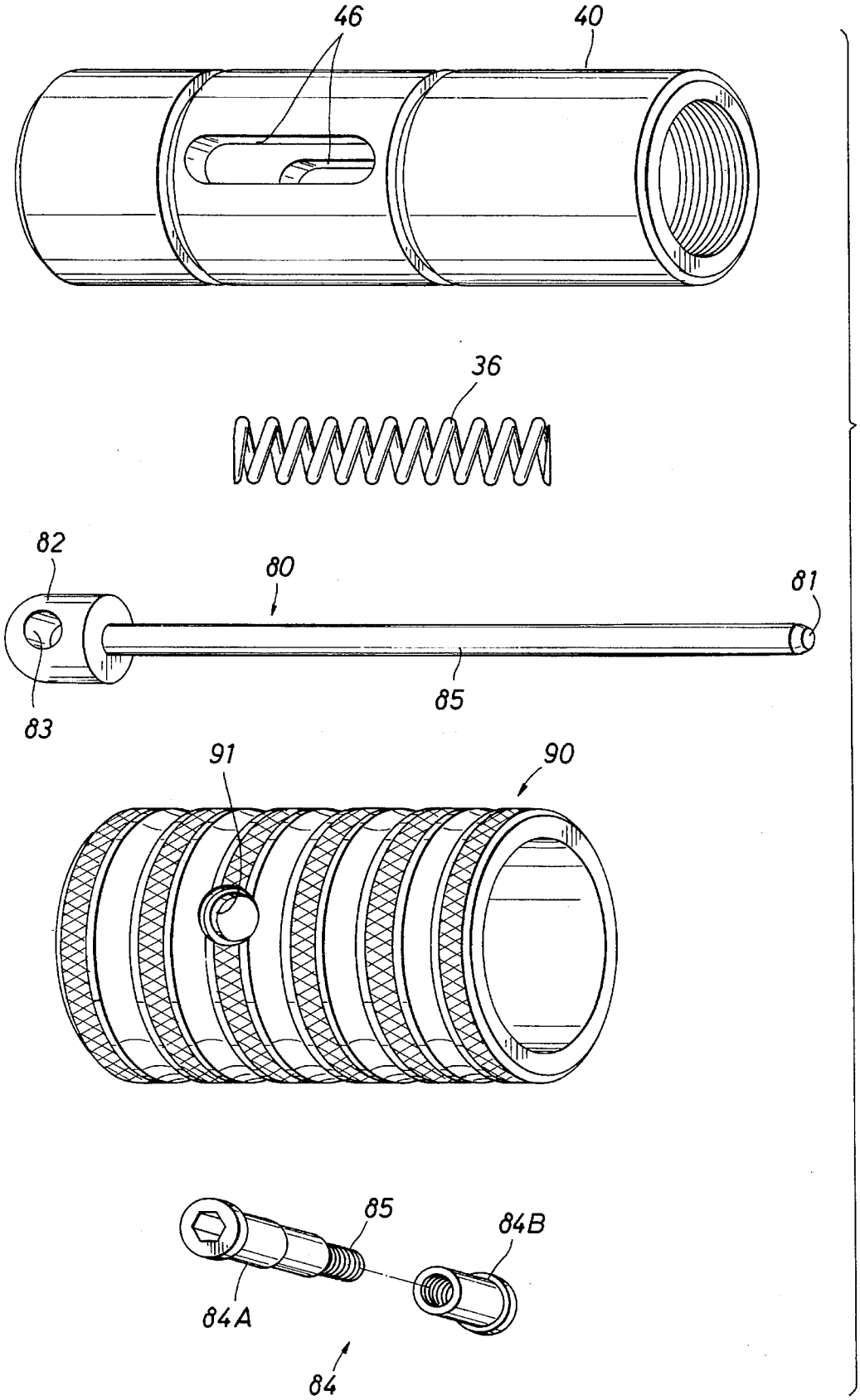
FIG. 2 is an exploded perspective of the valve release components of this invention.

This invention is, as mentioned, an improvement over the type of gun described in U.S. Pat. No. 5,349,982. There, as here, block 10 includes a first conduit 11 having threaded inlet 12 and outlet 13. Inlet 12 is connected to a source of water under pressure (not shown) by a tube (also not shown), while outlet 13 is linked to a nozzle-containing barrel (also not shown).

Also extending through block 10 in a direction generally parallel to first conduit 11, is a second conduit which includes valve-stem-guiding bore 21, which communicates with both trigger chamber 22 and the housing's central cavity 23. Said first and second conduits are linked by cross conduit 17. This central cavity 23, in turn, communicates with counterbore 25, and it with threaded counterbore 26. Dump tube adapter 30 includes a threaded end 31 which is removably received by said housing counterbore 26. Adapter 30 also is threaded, near its other end 32, to removably engage interior threads at one end 42 of dump tube 40, the other dump tube end being open. Adapter 30 also includes at end 32, a plurality of spaced, radial apertures 33.

A valve cartridge includes a seat housing 51, carrying an annular seat 52, and a depending spring cage 53. Said cartridge housing also includes axial bore 54 therethrough. Retainer 65 is received within an annular groove provided cage 53.

Reciprocatably positioned within cage 53 and engageable with seat 52, is valve 70, which has a depending stem 71, which stem slides within and is guided by housing block bore 21. The valve includes a beveled surface of end 72, and carries an annular flange. Spring 77 urges the valve out of engagement with seat 52. A pivotally positioned trigger engages the valve end opposite said beveled surface of 72 so as to urge it, against the bias of spring 77, toward its seat 52.

In operation, pressurized, or activating, fluid enters inlet 12 of the first conduit 11. If valve 70 blocks fluid flow through cross conduit 17, then such activating fluid will continue through outlet 13 and the related barrel and thereafter to perform its intended blasting function. On the other hand, if the valve is not seated, the pressurized water will continue at a low pressure through cross conduit 17, around the bevelled end of valve 70, through radial apertures 33 to exit the dump tube 40. Thus far, nothing new has been described relative to the subject matter described in said U.S. Pat. No. 5,349,982.

In the event of the valve being stuck, or jammed in the closed position, the improvement to be described hereafter would come into play.

The activating instrument for directly causing the unseating of valve 70 from seat 52, is actuator rod 80, preferably made of steel. This rod has a shank 85, and a valve engaging end 81 for abutting valve end 72 and urging it away from seat 52. The other rod end has an enlarged pin-receiving head 82. A radial passageway 83 through the head receives the 2-piece pin 84. Rod shank 85 is slidably received and guided by guideway aperture 35 through dump adapter end 32. Spring 36 urges rod end 81 out of engagement with valve end 72 by seating against rod head 82 and dump adapter end 32.

Generally cylindrical, hollow handle 90 includes an undulating outer hand grip surface. The handle is open at both ends. Its inner wall may slidably reciprocate along the outer wall of dump tube 40. Said dump tube includes a pair of o-rings 45 positioned in spaced annular grooves, for sealingly engaging the inner surface the central axial passageway through handle 90. Opposed, laterally elongated slots 46 extend through the walls of dump tube 40, approximately intermediate its ends 42, 47.

Opposed bores 91 extend through the wall of handle 90. When properly aligned, the male fastener component 84A, of pin 84 and the female component 84B having their tips 85 inserted through opposite ones of handle bores 91, then through slots 46 in dump tube 40, and finally to enter passageway 83 in rod 80 before the exterior threads of male member 84A engage the internal threads of female member 84B. Pin mechanism 84 is seen to be an effective means for transmitting force exerted against handle 90, to actuator rod 80.

Note that in the absence of actuation, spring 36 assures the disengagement of rod tip 81 from valve end 72. Now, however, assume that the valve becomes jammed with the valve seated, thereby barring the water from being dumped at a safe, low pressure. To disengage the valve and seat, the operator may engage the actuator mechanism. This comprises grasping handle 90 and pulling it toward block 10, causing it to slide along dump tube 10, in the manner of a pump-action shotgun. The handle is secured to actuator rod 80 by virtue of the pin connection mechanism 84. Thus as goes the handle, so goes actuator rod 80. Note that said rod is guided by guideway aperture 35. Axial movement of the actuator rod is limited by the end walls of elongated slots 46. However the range of such movement permits rod end 81 to engage valve end 72 and disengage said end from its seat, permitting pressure relief, thereby removing the safety hazard.

Although only a single embodiment has been described, it should be obvious that numerous modifications, including the actuating means for disengaging the valve, would be possible by one skilled in the art without departing from the spirit of the invention, the scope of which is limited only by the following appended claims.

We claim:

1. In a water blasting gun having a block with an activating fluid inlet, first and second activating fluid outlets, first conduit linking said inlet and said first outlet, second conduit linking said inlet and said second outlet, and valve means for selectively establishing communication between said inlet and one of said first and second outlets, said valve means including a valve member, a valve seat, and spring means biasing said valve member toward an unseated position, the improvement comprising:

user operated actuator means for unseating said valve member from said seat.

2. The gun of claim 1 wherein said actuator means includes rod means slidably positioned at least partially within a dump tube, which tube communicates with said second outlet.

3. The gun of claim 2 and including means biasing said rod means out of engagement with said valve member.

4. The gun of claim 3 wherein said actuator means includes means for urging said rod means in a direction opposed to said rod biasing means.

5. The gun of claim 4 wherein said rod urging means includes slidable handle means associated with said dump tube and linked to said rod means.

6. In a water blasting gun having a block with a high pressure fluid inlet, a high pressure fluid outlet, a dump fluid outlet, first fluid passageway linking said inlet with said high pressure outlet, second fluid passageway linking said inlet with said dump fluid outlet, means for selectively controlling the opening and blocking of said second fluid passageway, said controlling means including valve means, and a valve seat member and valve spring means biasing said valve means toward a position opening said second fluid passageway, the improvement comprising:

user operated actuator means for unseating said valve means from said seat.

7. The gun of claim 6 wherein said actuator means includes rod means slidably positioned and guided within a dump tube, which tube communicates with said dump fluid outlet, said rod means being removably engageable with said valve means.

8. The gun of claim 7 and including further spring means for biasing said rod means toward a position out of engagement with said valve means.

9. The gun of claim 8 wherein said actuator means also includes means for urging said rod means in a direction opposed to the direction urged by said rod biasing spring means.

10. The gun of claim 9 wherein said rod urging means includes handle means slidably associated with said dump tube and linked to said rod means.

11. In a water blasting gun having a housing with a high pressure fluid inlet, a high pressure fluid outlet, a dump fluid outlet, first fluid passageway means linking said inlet and said high pressure outlet, second fluid passageway means linking said inlet with said dump fluid outlet, trigger activated means for selectively controlling the blocking and unblocking of said second fluid passageway means, said controlling means including valve means movable between a second passageway blocking and an unblocking position, valve spring means biasing said valve means toward said unblocking position, and dump tube means linked to said housing and in communication with said dump outlet, the improvement comprising:

user operated actuator means for urging said valve means toward said unblocking position.

12. The gun of claim 11, wherein said actuator means includes rod means slidably positioned centrally of said dump tube means, said rod means being removably engageable with said valve means.

13. The gun of claim 12 and including further spring means for biasing said rod means in a direction away from engagement with said valve means.

14. The gun of claim 13 wherein said actuator means also includes means for moving said rod means in a direction toward engagement with said valve means.

15. The gun of claim 14 wherein said rod moving means includes handle means slidably engaged with said dump tube means, and force transmission means linking said handle means and said rod means.

* * * * *